US007506873B1

(12) United States Patent
Barrie

(10) Patent No.: US 7,506,873 B1
(45) Date of Patent: Mar. 24, 2009

(54) METHOD FOR PLAYING POKER

(76) Inventor: Robert P. Barrie, 22 Savannah Way, Merrimack, NH (US) 03054

( * ) Notice: Subject to any disclaimer, the term of this patent is extended or adjusted under 35 U.S.C. 154(b) by 232 days.

(21) Appl. No.: 11/701,803

(22) Filed: Feb. 2, 2007

(51) Int. Cl.
*A63F 9/22* (2006.01)

(52) U.S. Cl. ..... 273/274; 273/292; 463/13

(58) Field of Classification Search ..... 273/274, 273/292; 463/12, 13
See application file for complete search history.

(56) References Cited

U.S. PATENT DOCUMENTS

| | | | | |
|---|---|---|---|---|
| 1,723,377 | A * | 8/1929 | Salomon | 273/269 |
| 6,132,311 | A * | 10/2000 | Williams | 463/13 |
| 6,220,959 | B1 * | 4/2001 | Holmes et al. | 463/13 |
| 6,406,023 | B1 * | 6/2002 | Rowe | 273/292 |
| 6,443,456 | B1 * | 9/2002 | Gajor | 273/303 |
| 6,547,242 | B1 * | 4/2003 | Sugiyama et al. | 273/142 R |
| 6,676,511 | B2 * | 1/2004 | Payne et al. | 463/20 |
| 6,729,618 | B1 * | 5/2004 | Koenig et al. | 273/138.2 |
| 7,137,883 | B1 * | 11/2006 | Falciglia, Sr. | 463/13 |
| 7,166,028 | B2 * | 1/2007 | Fasbender et al. | 463/20 |
| 2002/0086725 | A1 * | 7/2002 | Fasbender et al. | 463/11 |
| 2002/0187823 | A1 * | 12/2002 | Khal | 463/13 |
| 2003/0130024 | A1 * | 7/2003 | Darby | 463/13 |
| 2006/0116195 | A1 * | 6/2006 | Baerlocher et al. | 463/20 |
| 2007/0111782 | A1 * | 5/2007 | Adams et al. | 463/17 |
| 2007/0129137 | A1 * | 6/2007 | Walker et al. | 463/25 |
| 2007/0275778 | A1 * | 11/2007 | Fong et al. | 463/20 |
| 2008/0171587 | A1 * | 7/2008 | Jackson | 463/20 |

* cited by examiner

*Primary Examiner*—William M Pierce
(74) *Attorney, Agent, or Firm*—Joseph E. Funk

(57) ABSTRACT

The novel video draw poker game disclosed utilizes a nine position card matrix in which two through four cards are initially dealt and displayed in one row at the start of game play. Pay lines pass through the nine positions. The player selects and holds ones of the initially dealt cards. After holding cards the non-held cards are replaced and other positions in the card matrix are filled to determine winning hands of cards along the pay lines.

7 Claims, 6 Drawing Sheets

METHOD FOR PLAYING POKER

FIELD OF THE INVENTION

The invention relates to electronic video poker games.

BACKGROUND OF THE INVENTION

Gaming machines, such as video poker machines and the like, have been the cornerstone of the gaming industry for a number of years. Generally, the popularity of such gaming machines with players is dependent on the perceived likelihood of winning money at the machine and the intrinsic entertainment value of the machine. Players are most likely to be attracted to the most entertaining and exciting of these machines. Therefore, owner/operators of such video poker machines constantly strive to employ the most entertaining and exciting machines available because such machines attract frequent play and hence increase profitability to the machine operator. Accordingly, in the competitive gaming machine industry, there is a continuing need for gaming machine manufacturers to produce new types of poker games, or enhancements to existing poker games, which will attract frequent play by enhancing the entertainment value and excitement associated with the games, and by increasing a player's perception that they have a better chance to win when playing a game.

In the prior art there are two types of games. There is the standard 3×5 "five reel slot" machine where all symbols are randomly dealt and displayed and there is no player skill. The other type has a level of player skill. An example of this type of game is Draw Poker in which there is an initial deal of cards from which a player selects cards to be held and non-selected cards are replaced with new cards to improve the value of the player's hand.

The introduction of computerized video poker games permits players to see the representation of dealt hands on a video screen, and the players usually play against a standard payout table retained in the computer's memory. Conventional video draw poker is a single player game in which a player does not play against a dealer or other players, but rather tries to achieve the highest possible paying poker hand. A payout schedule is used to determine the amount awarded to the player for achieving specified winning combinations of cards.

In this standard poker format, the player has the option of holding or replacing 0, 1, 2, 3, 4 or 5 of the original dealt five cards. After the deal and draw phases, the resultant hand is evaluated against a posted list of winning combinations called a pay table. The ability to hold or replace cards gives the player some advantage in forming a winning hand of 5 cards. The pay table is designed against this player advantage to produce a game which has a certain game percent. This percent is typically defined as the percentage retained by the house or returned to the player.

The pay table combinations are ordered from highest to lowest and are typically royal flush, straight flush, four of a kind, full house, flush, straight, three of a kind, two pair and jacks or better. The highest paying combinations (e.g. royal flush) have the lowest chance of occurring and the most frequently occurring are the lowest paying (e.g. jacks or better). Variations in player advantage such as the introduction of wild cards are balanced by changes in the pay table to derive a certain desired game percent.

One concept that has been successfully employed to enhance the entertainment value of a game is the concept of multiple pay lines that exceed the number of actual horizontal rows of a matrix of cards displayed on a video gaming machine. In such poker machines the pay lines include not only actual horizontal rows of cards being displayed but the pay lines also include cards in positions in more than one horizontal row of the matrix. Thus, some pay lines zig-zag between displayed horizontal rows and the number of pay lines greatly exceed the actual number of horizontal rows of cards being displayed in the matrix.

More particularly, a typical gaming device might have a 3×5 matrix (3 rows by 5 columns). This matrix easily and clearly supports three horizontal pay lines through the three rows of the matrix. To increase the number of pay lines the pay lines zig-zag between the rows of the 3×5 matrix and pass through only one card per column in the matrix. With this technique there are $3^5$ (243) ways of choosing five symbols, one from each column in a 3×5 matrix.

In the simple slot matrix, multiple pay lines have been employed for many years and are well known in the art. In deal and draw poker games various pay lines zig-zag through the matrix that create different hands and motivate different holds per hand (or pay line) which would be time consuming and complicated to perform. One approach is to draw on only one row of the matrix of cards and copy the held card across all the cards in that column thereby holding it in all pay lines since all pay lines intersect that column in one of the cards. This ability to make one set of holds work across multiple pay lines has been very successful.

Over time gaming casino patrons become bored with standard versions of poker games and the casinos are continually looking for new variations of existing video poker games to continually create renewed interest and attract more players to play video poker.

Therefore, there is a need in the prior art to have a new poker game which is similar to conventional poker games in its playing strategy. Such a new game would stimulate renewed interest of experienced players, and the interest of casual players, who will both find the new game exciting.

SUMMARY OF THE INVENTION

The need in the prior art for a new video poker game is satisfied by the present invention which is mixing the qualities of a slot matrix with its zig-zag lines and limited draw poker. This invention combines the slots established ability to form multiple pay lines by choosing different cards in some columns of the matrix with the ability to hold and replace cards in the other columns of the matrix. There is a card display matrix that looks like the letter "H". Cards are dealt, held and replaced in this "H" shaped display matrix and pay lines zig-zag through the matrix. The cross bar of the "H" has a row of five card display positions, and above and below the first and fifth card display position is another card display position. This defines a first and a fifth column. There is no second, third or fourth column. The pay lines commence with any of the three card display positions in the first column, pass through the second, third and fourth positions in the row, and terminate at the three card display positions in the fifth column. Thus, there are a total of nine pay lines that may be selected and played by a player. Each pay line represents a hand of cards that can be selected and played.

Following the placement of bets and selecting the number of pay lines to be played the player commences game play by touching a DEAL button that is displayed on the video display screen. Three cards are dealt face up in only the second, third and fourth card display positions in the middle five row of the "H" shaped display matrix. The player selects 0, 1, 2 or 3 of these three cards to be held by touching them on the video display screen. Held cards are marked as held.

The player then touches a DRAW button displayed on the video display screen. Responsive thereto the game software randomly displays cards face up in the first and fifth column and replaces the non-held ones of the three cards with replacement cards.

The game software then determines if there are winning card combinations on the player selected ones of the nine pay lines. Winning hands along pay lines are displayed to the player and winnings are paid to the player based on a pay table and the number of bets placed on the winnings hands of cards.

Being as the player can only hold and reject cards from amongst the three cards initially dealt, rather than from amongst five cards as in the prior art, the odds in the game change. The result is that the pay table shows higher pays for winning hands. This appeals to a player because it appears they have a chance for higher winnings. In reality the odds balance out due to having only three cards that may be selected to be held or to be replaced.

DESCRIPTION OF THE DRAWINGS

The invention will be better understood upon reading the following Detailed Description in conjunction with the drawing in which.

DETAILED DESCRIPTION

Figure 1:
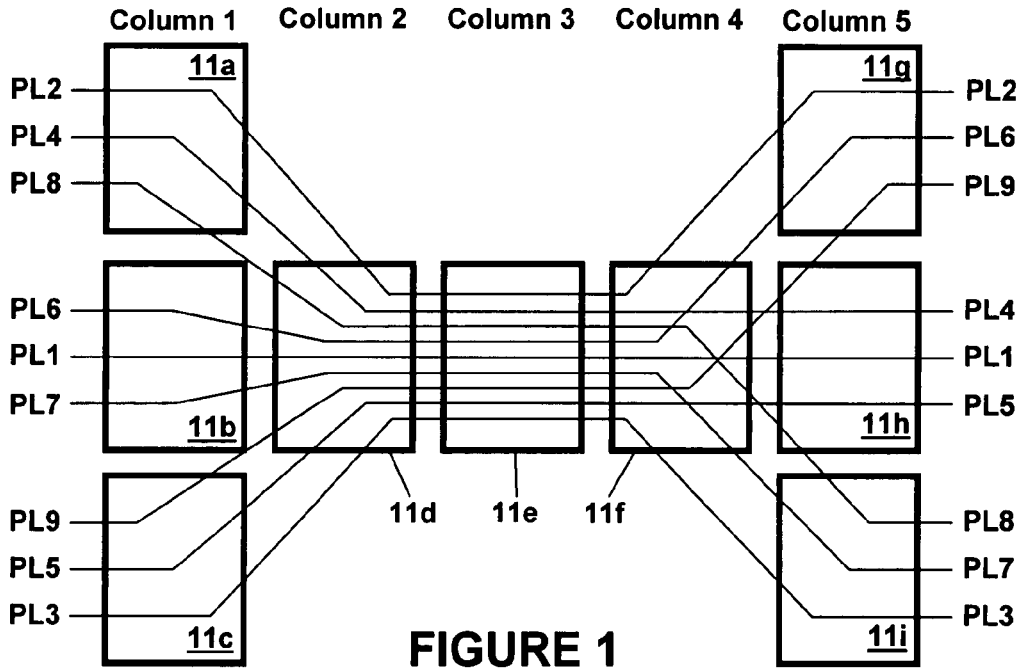
FIG. 1 shows the "H" shaped playing field and the nine pay lines that pass there through of the present invention.

In FIG. 1 is shown the "H" shaped draw poker playing field and the nine player selected pay lines that pass there through in accordance with the preferred embodiment of the present invention. The playing field consists of nine card display positions (11*a*-11*i*) in which cards may be displayed during the course of game play. These card display positions designations 11*a*-11*i* are used elsewhere in this detailed description but the designations are not shown in any other figures to avoid cluttering the drawing. The nine pay lines used in the poker game are designated PL1-PL9 and zig-zag through the nine card display positions 11*a*-11*i*.

When a player commences card play they get pay line PL1 representing a single hand of cards. As they select additional pay lines or hands of cards they will enable, in sequence, pay lines PL2 through PL9.

Figure 2:
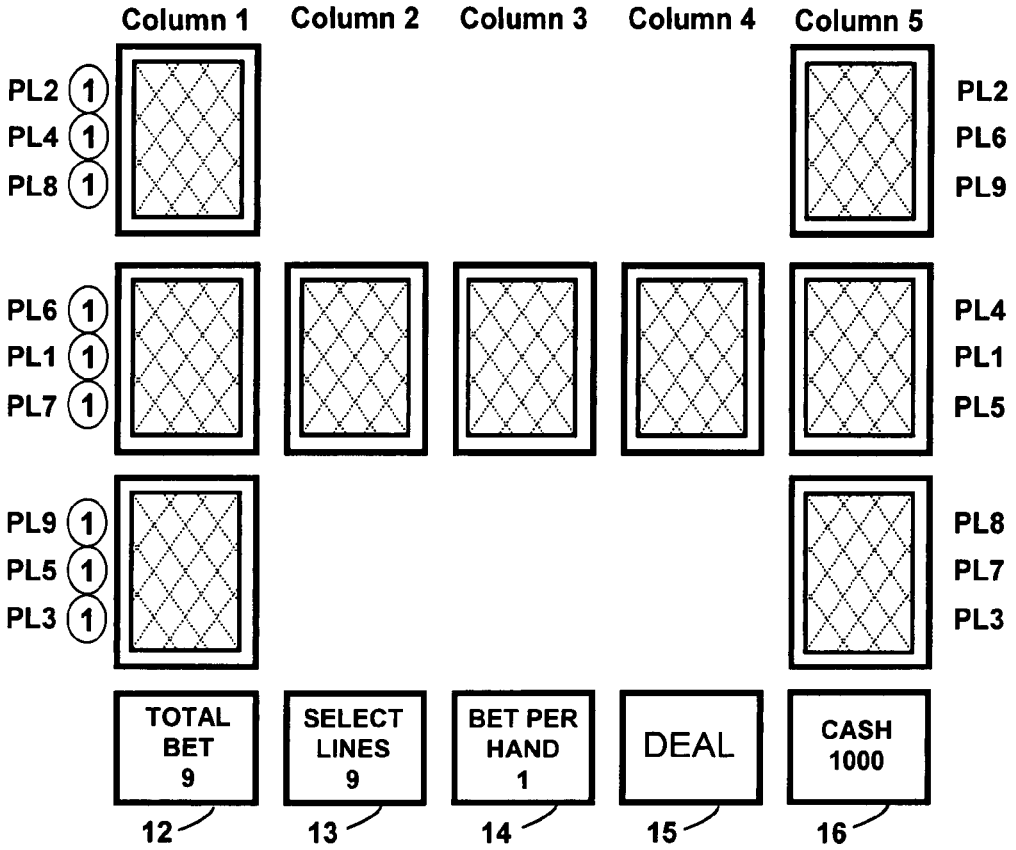
FIG. 2 shows the back side of cards displayed in the "H" shaped playing field and the game play buttons displayed on screen.

FIG. 2 shows the back side of cards at each of the nine card display positions 11*a*-11*i* and game play buttons 12-16 displayed on the video display. The display in FIG. 2 is what a player sees before they commence game play. To commence play a player inserts a type of credit card (not shown) into a card slot (not shown) on the video game. The number of game play credits that a player has are indicated on the card and are displayed at CASH position 16 of the display. As indicated in FIG. 1 the player has 1000 credits with which to play.

The player selects the number of pay lines, PL1-PL9, they wish to play by touching SELECT LINES button 13. Touch screen technology senses each touch and displays the number of player selected pay lines within the button. The first time button 13 is touched a number 1 in a circle appears adjacent to the designation PL1 at the left side of the card display positions 11*a*-11*i*. At the same time the number "1" is displayed inside button 13. Thereafter, each time that button 13 is touched the number "1" in a circle appears adjacent to the appropriate pay line designation at the left side of the card display positions 11*a*-11*i* and the number displayed in button 13 is incremented. In FIG. 2 the player has touched button 13 nine times to play all nine pay lines PL1-PL9. Thus, the number "9" is displayed inside button 13 and a "1" in a circle is displayed by each pay line designation PL1-PL9.

The player may also select the number of bets to be placed on each of pay lines PL1-PL9 using BET PER HAND button 14. As shown in FIG. 2 the player is placing one bet on each hand/pay line, as indicated by the number "1" displayed in button 14, but the player may touch button 14 to increment the number of bets placed. If the player touches button 14 three times they will increment the number of bets per hand/pay line from one to four bets. In FIG. 2 and for all the examples of game play described hereinafter the player is playing all nine pay lines, is placing one bet on each of pay lines PL1-PL9 for a total of nine bets, and the number "9" is displayed in TOTAL BET box 12.

After the player has placed bets and selected the pay lines to be played, as described above, they touch on screen DEAL button 15 to commence a round of game play. As long as the player does not change their initial selections for pay lines and bets per hand those selections do not change, but a player may change their selections between each round of game play in a manner well known in the art.

Figure 3:
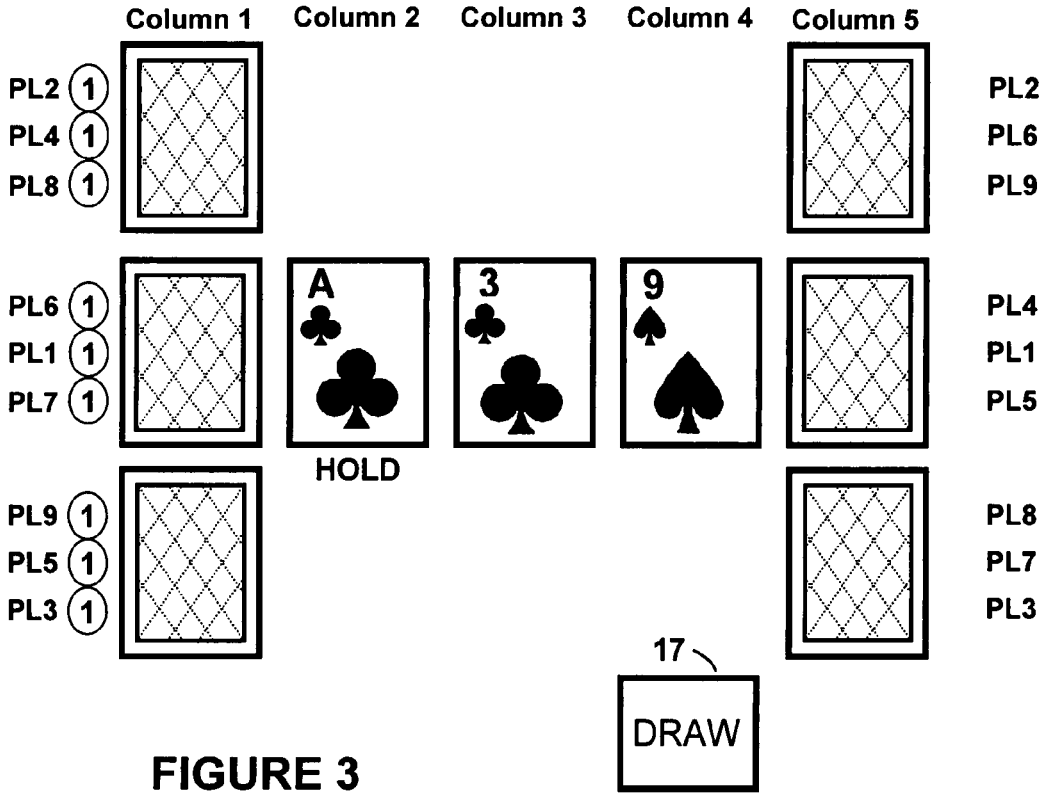
FIG. 3 shows the three cards displayed after bets are placed and a Deal button is touched for a first round of game play, and card(s) held by the player.

FIG. 3 shows the three cards displayed after bets are placed and DEAL button 15 is touched for a first round of game play. The three cards are the Ace of clubs displayed in position 11*d*, the three of clubs displayed in position 11*e* and the nine of spades displayed in position 11*f*. The player studies the three cards to make a choice as to which of the three cards they wish to hold. The player touches the on screen card position of any card(s) they wish to hold and the card has the word HOLD displayed underneath the held card position. In FIG. 2 the player has decided to hold only the Ace of clubs and has touched position 11*d*. The word HOLD is displayed under the Ace of clubs.

Figure 4:
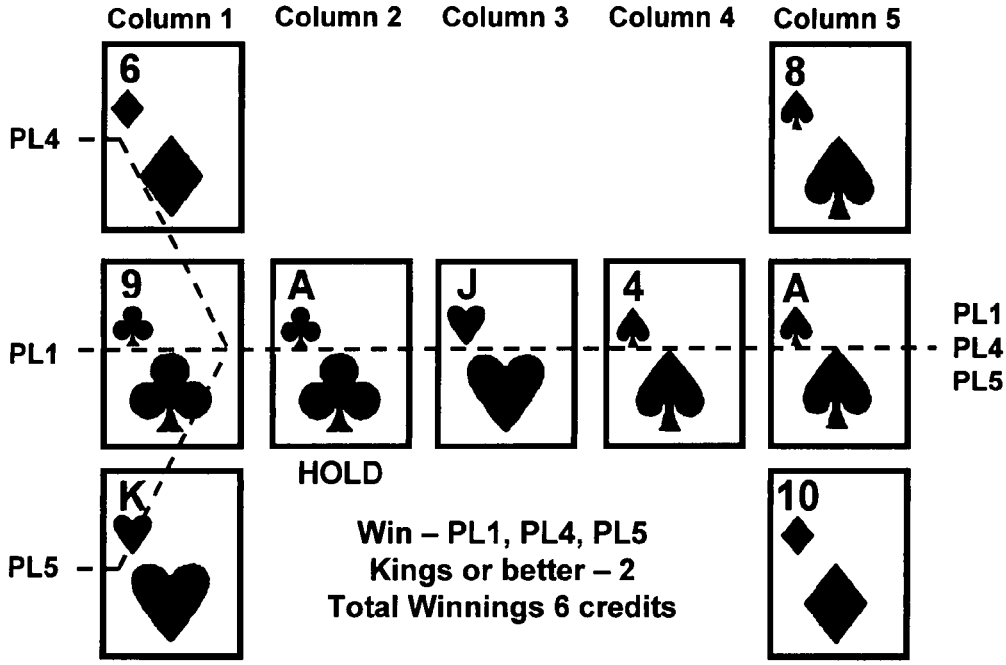
FIG. 4 shows all nine cards displayed and winning hands of cards along player selected pay lines after the Draw phase of game play for the first round of game play.

After picking cards to be held the player touches DRAW button 17. Responsive thereto the game software holds the Ace of clubs, and replaces the three of clubs and the nine of spades. The game software also randomly selects cards to be displayed in positions 11*a*-11*c* and 11*g*-11*i*. This is shown in FIG. 4. The three of clubs is replaced by the Jack of hearts and the nine of spades is replaced by the four of spades. Positions 11*a*-11*c* are filled by the six of diamonds, the nine of clubs and the King of hearts. Positions 11*g*-11*i* are filled by the eight of spades, the Ace of spades and the ten of diamonds.

The game software then determines the winning hands and displays this information on screen as shown in FIG. 4. For the first round of game play there are winning combinations of cards along pay lines PL1, PL4 and PL5 and the winning pay lines are shown as dotted lines on screen to aid the player. All three hands are nines or better, each hand yielding winnings of one credits, for a total of three credits. Along each of pay lines PL1, PL4 and PL5 there are a pair of Aces.

Figure 5:
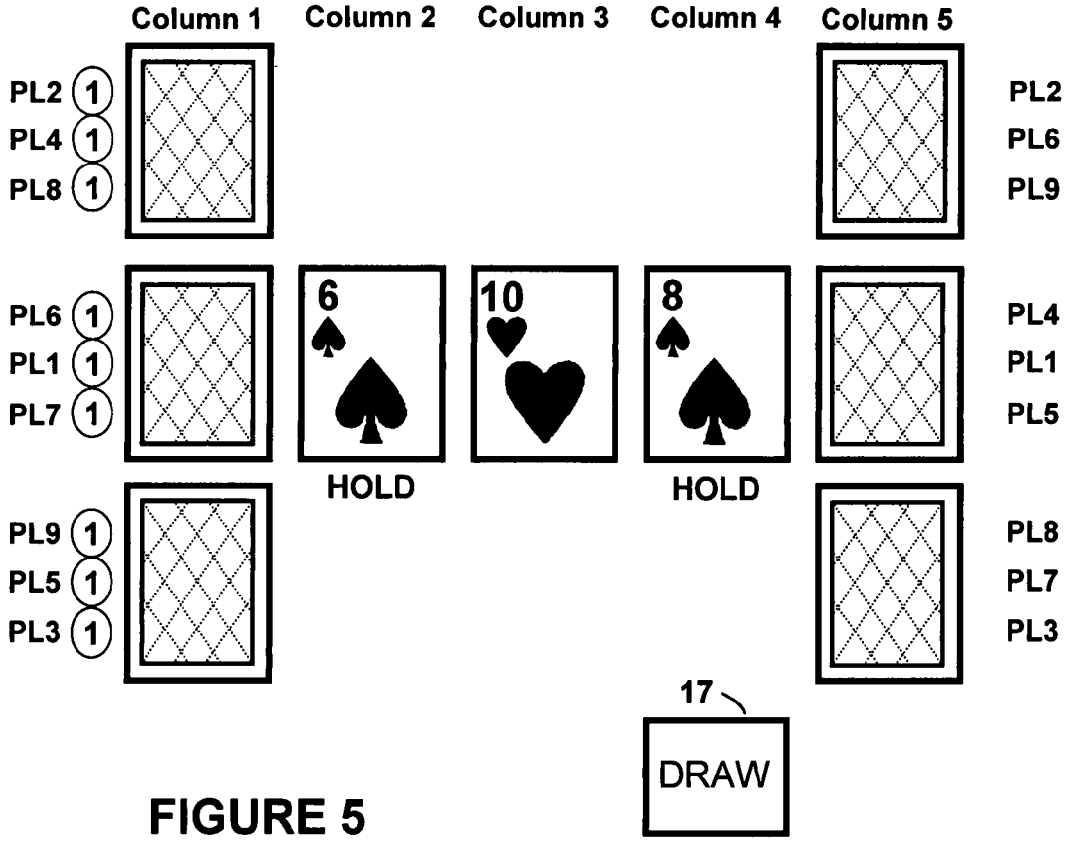
FIG. 5 shows the three cards displayed after bets are placed and a Deal button is touched for a second round of game play, and card(s) held by the player.
Figure 6:
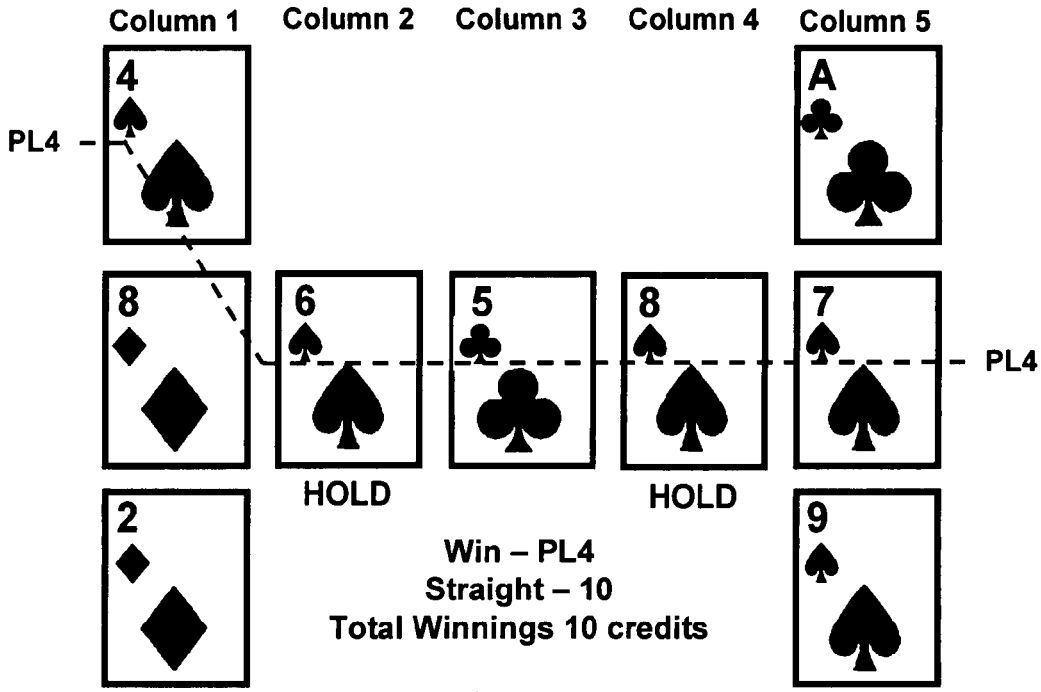
FIG. 6 shows all nine cards displayed and winning hands of cards along player selected pay lines after the Draw phase of game play for the second round of game play.

In FIGS. 5 and 6 are shown a second round of game play. For the second round of game play the player does not change their number of selected hands or the number of bets per hand. Although it is not shown in FIG. 5, after the end of the first round of game play the buttons and display positions 12-16 are again displayed and the player may change their game play selections. This is well known in the art and has been dispensed with to simplify the description of game play and the drawings. After the player has touched DEAL button 15 the display changes to that shown in FIG. 5. The six of spades is displayed in position 11*d*, the ten of hearts is displayed in position 11*e* and the eight of spades is displayed in position 11*f*. The player studies these cards and decides to hold the six of spades and the eight of spades. The player touches these two cards and the word HOLD is displayed under the two cards as shown.

After picking the cards to be held the player touches DRAW button 17. Responsive thereto the game software holds the six of spades and the eight of spades, and replaces the ten of hearts with a five of clubs. The game software also randomly selects cards to be displayed in positions 11*a*-11*c* and 11*g*-11*i*. This is shown in FIG. 6. Positions 11*a*-11*c* are filled by the four of spades, the eight of diamonds and the two of diamonds. Positions 11*g*-11*i* are filled by the Ace of clubs, the seven of spades and the nine of spades.

The game software then determines the winning hands and displays this information on screen as shown in FIG. 6. For the second round of game play the one winning combination of cards is on pay line PL4 and this pay line is displayed as a dotted line to aid the player. The winning hand combination is a straight yielding total winnings of ten credits.

Figure 7:
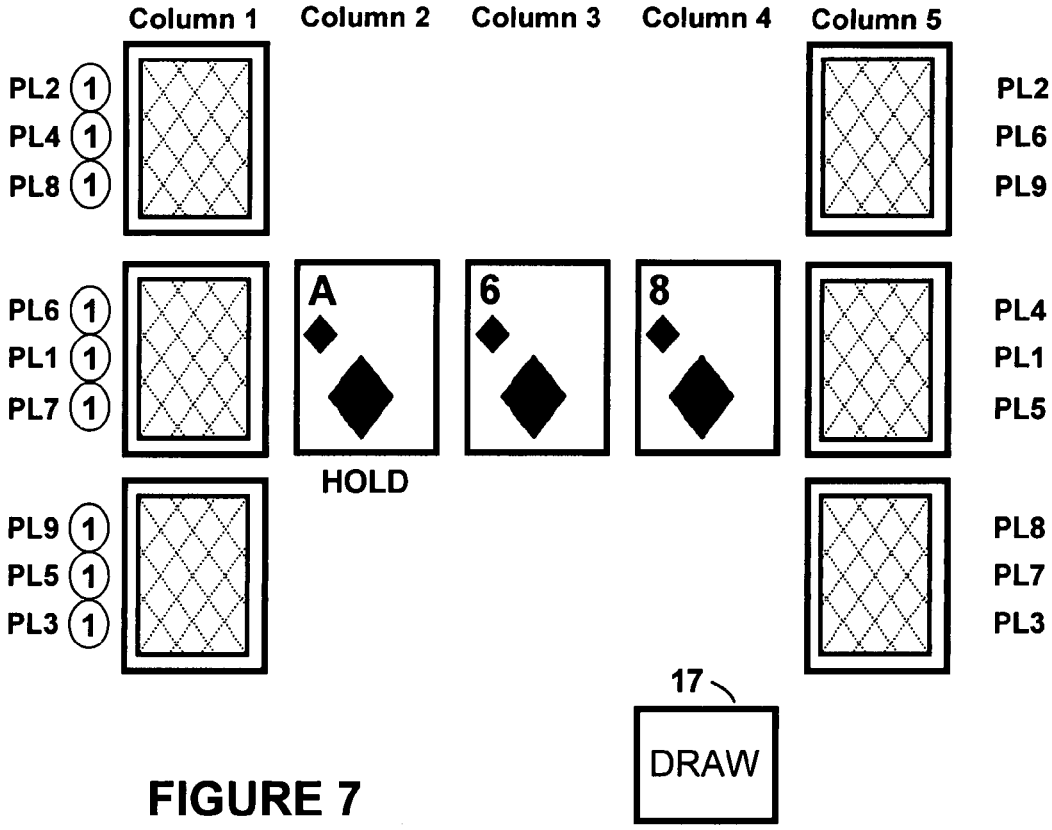
FIG. 7 shows the three cards displayed after bets are placed and a Deal button is touched for a third round of game play, and card(s) held by the player.
Figure 8:
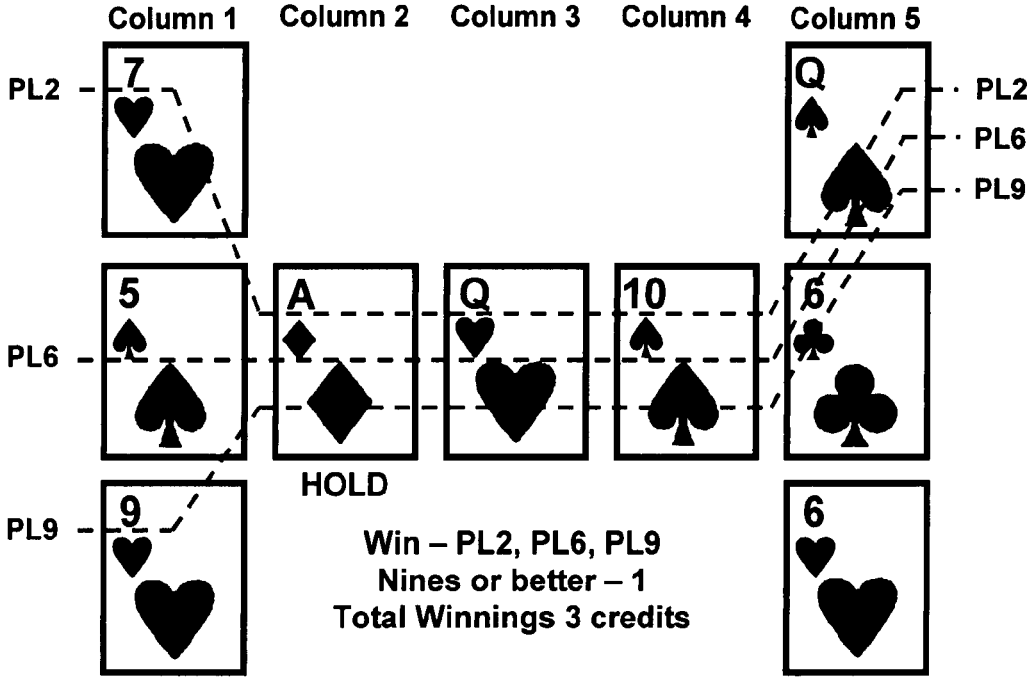
FIG. 8 shows all nine cards displayed and winning hands of cards along player selected pay lines after the Draw phase of game play for the third round of game play.

In FIGS. 7 and 8 are shown a third round of game play. For the third round of game play the player does not change their number of selected hands or the number of bets per hand. Although it is not shown in FIG. 7, after the end of the second round of game play the buttons and display positions 12-16 are again displayed and the player may change their game play selections. This is well known in the art and has been dispensed with to simplify the description of game play and the drawings. After the player has touched DEAL button 15 the display changes to that shown in FIG. 7. The Ace of diamonds is displayed in position 11*d*, the six of diamonds is displayed in position 11*e* and the eight of diamonds is displayed in position 11*f*. The player studies these cards and decides to hold only the Ace of diamonds. The player touches this card and the word HOLD is displayed under the card in position 11*d* as shown.

After picking the Ace of diamonds to be held the player touches DRAW button 17. Responsive thereto the game software holds the Ace of diamonds, replaces the six of diamonds with a Queen of hearts and replaces the eight of diamonds with a ten of spades as shown in FIG. 8. The game software also randomly selects cards to be displayed in positions 11*a*-11*c* and 11*g*-11*i*. This is shown in FIG. 8. Positions 11*a*-11*c* are filled by the seven of hearts, the five of spades and the nine of hearts. Positions 11*g*-11*i* are filled by the six of spades, the Queen of clubs and the six of hearts.

The game software then determines the winning hands of cards and displays this information on screen as shown in FIG. 8. For the third round of game play the winning card hands are on pay lines PL2, PL6 and PL9 and these pay lines are shown as dotted lines on screen to aid the player. The winning combinations are nines or better, a pair of queens, each yielding winnings of one credit for a total of three credits.

Figure 9:
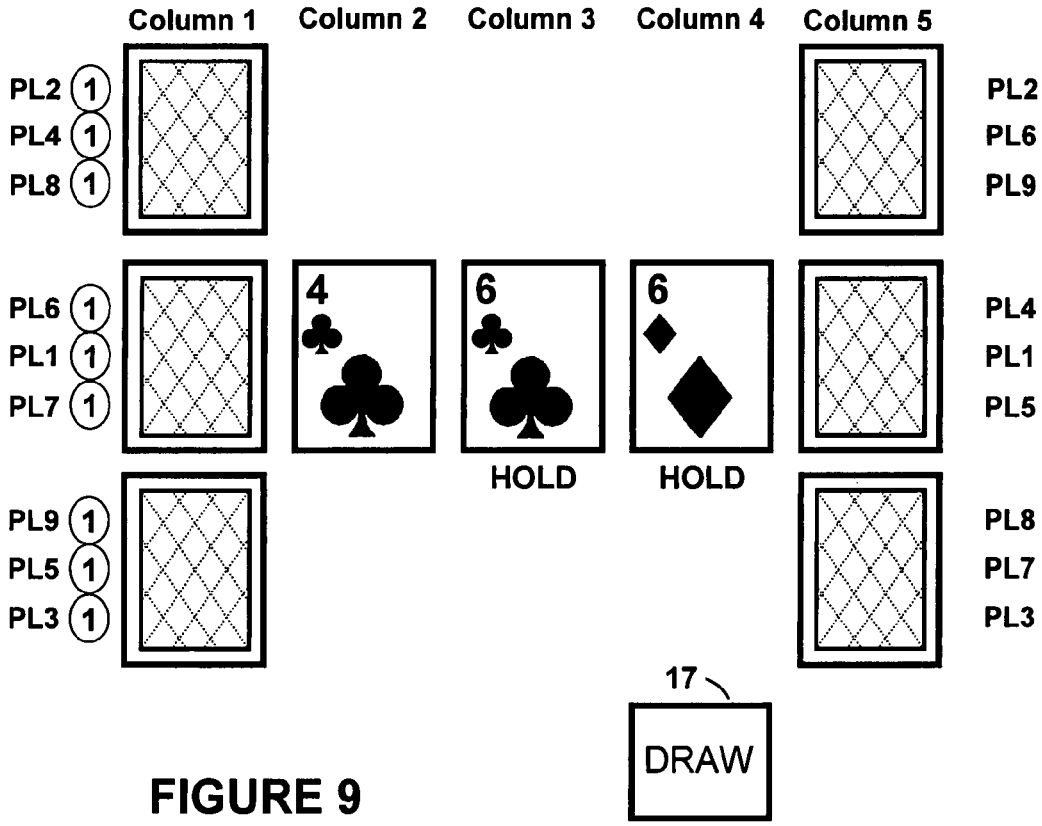
FIG. 9 shows the three cards displayed after bets are placed and a Deal button is touched for a fourth round of game play, and card(s) held by the player.
Figure 10:
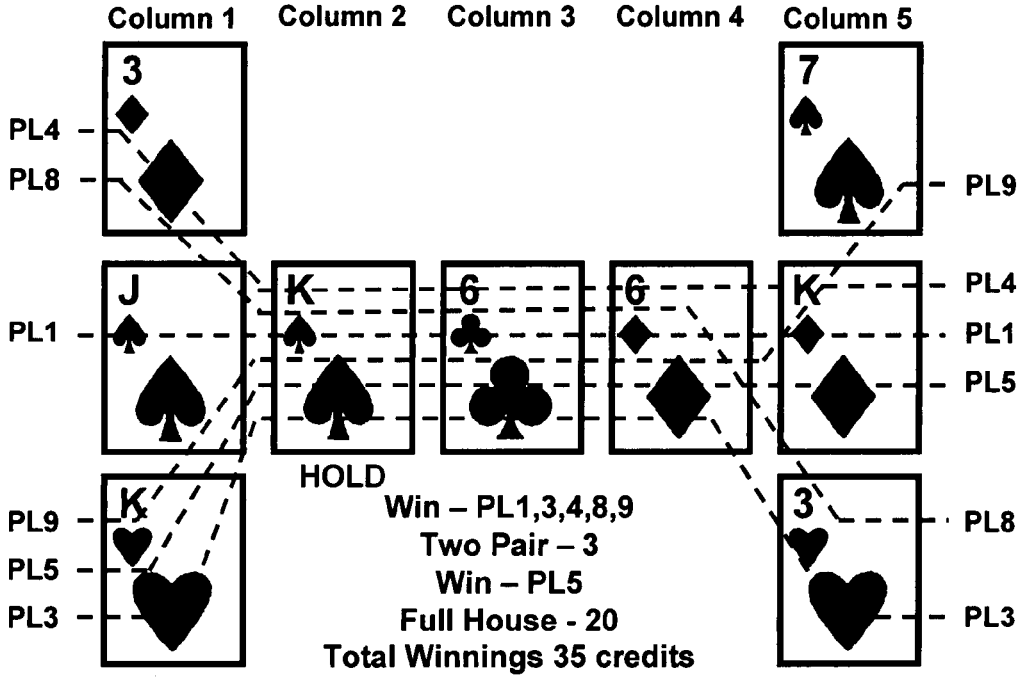
FIG. 10 shows all nine cards displayed and winning hands of cards along player selected pay lines after the Draw phase of game play for the fourth round of game play.

In FIGS. 9 and 10 are shown a fourth round of game play. For the fourth round of game play the player does not change their number of selected hands or the number of bets per hand. Although it is not shown in FIG. 7, after the end of the third round of game play the buttons and display positions 12-16 are again displayed and the player may change their game play selections. This is well known in the art and has been dispensed with to simplify the description of game play and the drawings. After the player has touched DEAL button 15 the display changes to that shown in FIG. 9. The four of clubs is displayed in position 11*d*, the six of clubs is displayed in position 11*e* and the six of diamonds is displayed in position 11*f*. The player studies these cards and decides to hold the six of clubs and the six of diamonds. The player touches these two cards and the word HOLD is displayed under the cards as shown.

After picking the two cards to be held the player touches DRAW button 17. Responsive thereto the game software holds the six of clubs and the six of diamonds, and replaces the four of clubs with a King of spades as shown in FIG. 10. The game software also randomly selects cards to be displayed in positions 11*a*-11*c* and 11*g*-11*i*. This is shown in FIG. 10. Positions 11*a*-11*c* are filled by the three of diamonds, the Jack of spades and the King of hearts. Positions 11*g*-11*i* are filled by the seven of spades, the King of diamonds and the three of hearts.

The game software then determines the winning hands of cards and displays this information on screen as shown in FIG. 10. For the fourth round of game play the winning combinations are on pay lines PL1, PL3, PL4, PL5, PL8 and PL9 and these pay lines are displayed as dotted lines on screen to aid the player. Pay lines PL1, PL3, PL4, PL8 and PL9 each have two pair and pay line PL5 has a full house. Pay lines PL1, PL3, PL4 and PL9 each have a pair of Kings and a pair of sixes. Pay line PL8 has a pair of threes and a pair of sixes. Pay line PL5 has three Kings and two sixes. The total winnings are thirty five credits.

While the player has winnings in the four rounds of game play described hereinabove, in reality the player will have many rounds of game play in which they have no winnings.

Figure 11:
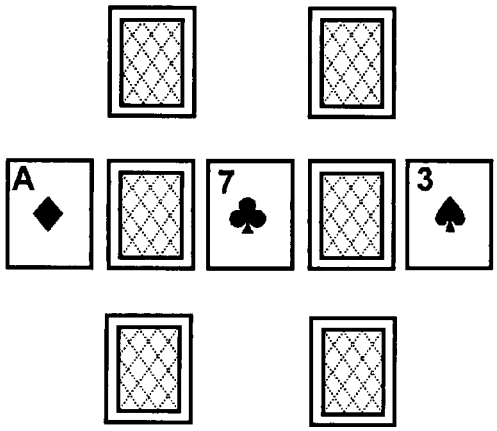
FIG. 11 shows a first alternative embodiment of the invention where the initially dealt cards are in different positions than in the preferred embodiment of the invention.
Figure 12:
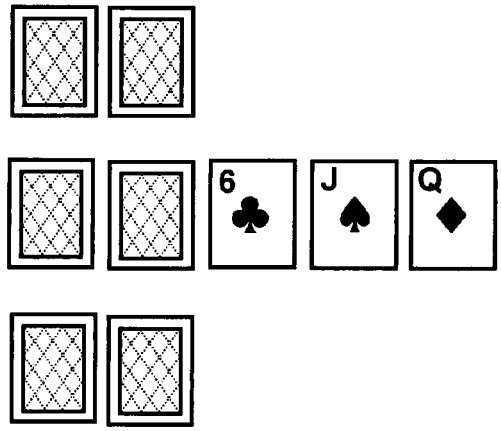
FIG. 12 shows a second alternative embodiment of the invention where the dealt cards are in different positions than in the preferred embodiment of the invention.

In a first alternative embodiment of the invention cards can be initially dealt into any positions that are less than all the positions in the middle row through the 3×5 matrix. That is, cards may be initially dealt into any two, three or four of the matrix positions 11*b*, 11*d*, 11*e*, 11*f* or 11*h*. Any of these initially dealt cards may be held or are not held and replaced as described hereinabove. For one example, as shown in FIG. 11 the three initially dealt cards are in positions 11*b*, 11*e* and 11*h*. They are the Ace of diamonds, the seven of clubs and the three of spades. For another example, as shown in FIG. 12 there are three initially dealt cards are in positions 11*e*, 11*f* and 11*h*. They are the six of clubs, the jack of spades and the queen of diamonds. In all these instances when fewer than five cards are initially dealt the odds in the game change and affect the pay table for the game.

Figure 13:
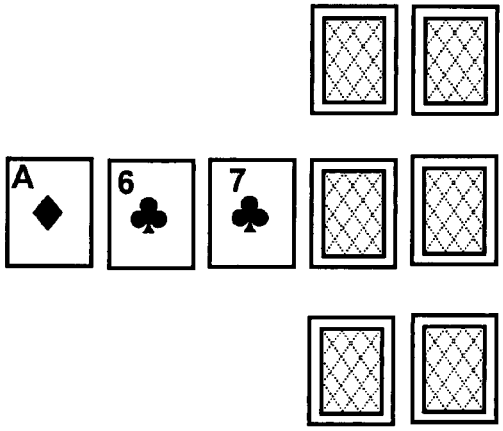
FIG. 13 shows a third alternative embodiment of the invention where the dealt cards are in different positions than in the preferred embodiment of the invention.
Figure 14:
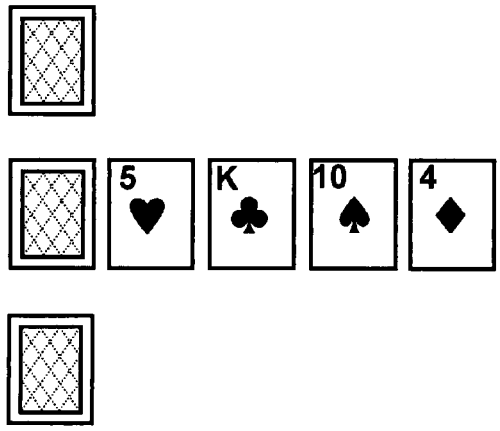
FIG. 14 shows a fourth alternative embodiment of the invention where the dealt cards are in different positions than in the preferred embodiment of the invention.

In a second alternative embodiment of the invention the matrix may be expanded or contracted above and below card positions in the row comprising matrix positions 11*b*, 11*d*, 11*e*, 11*f* or 11*h* at other than the first and last positions of the row of positions. That is, the matrix positions designated 11*a* and 11*c*, and 11*g* and 11*i* for the preferred embodiment of the invention may not be respectively above and below positions 11*b* and 11*h* as shown in FIG. 1 but, instead, may be above and below other matrix positions. See FIGS. 13 and 14. In FIG. 13 there are matrix positions above and below positions 11*f* and 11*h*. In FIG. 14 there are matrix positions only above and below position 11*b*. Other configurations may be utilized within the teaching of the invention as long as cards are not initially dealt into all of five positions 11*b*, 11*d*, 11*e*, 11*f* and 11*h* and the player can hold cards in all five positions.

While what has been described hereinabove are several examples of Match Poker game play per the preferred embodiment of the invention, and some alternative embodiments of the invention it should be understood that numerous changes may be made without departing from the spirit and scope of the invention. For example, the matrix positions in the first and third row need not always be above and below a position in the middle row in which cards are not initially dealt.

The invention claimed is:

1. A method for a player to play a game of draw poker that utilizes a matrix of horizontally and vertically oriented positions in which cards are dealt during play of the draw poker game, the matrix having a plurality of columns and plural pay lines pass through one card in each column of the matrix, the method comprising the steps of:

(a) initially randomly dealing cards face up in less than all the positions of one row of positions through the matrix;

(b) letting the player select any of the cards dealt in step (a) to be held;

(c) replacing the card(s) that are not held in step (b);

(d) dealing face up cards in the positions of the one row of positions through the matrix that did not have a card dealt therein in step (a) to complete a hand of cards in that row;

(e) dealing a face up card into matrix positions both above and below the positions of the one row of positions through the matrix into which cards are dealt in step (d); and (d) determining which pay lines through the matrix have winning combinations of cards along them.

2. The method for playing a draw poker game in accordance with claim 1 wherein the one row through the matrix has five positions into which cards can be dealt, and with the matrix positions both above and below the first and last positions of the row of positions through the matrix there are a total of nine positions in the matrix into which cards can be dealt.

3. The method for playing a draw poker game in accordance with claim 2 wherein the cards dealt in step (a) are dealt into the second, third and fourth positions of the one row of positions through the matrix.

4. A method for a player to play a draw poker game that utilizes a matrix of positions in which cards are dealt during play of the draw poker game, the matrix having a plurality of columns and plural pay lines pass through one card in each column of the matrix, the matrix having a row of five positions and having a position above and a position below the first and fifth positions of the row of five positions, the method comprising the steps of:

(a) dealing three cards face up into the second, third and fourth positions of the row of five positions;

(b) letting the player select any of the three cards be held and the non-selected cards will be replaced;

(c) replacing the card(s) that are not held in step (b);

(d) dealing face up cards into the first and fifth positions of the row of five card positions to complete a hand of five cards in that row;

(e) dealing a face up card into the positions above and below the first and fifth positions of the row of five positions; and (d) determining which pay lines through the columns of the matrix having winning combinations of cards along them.

5. A method for a player to play a draw poker game that utilizes a matrix of horizontally and vertically oriented positions in which cards are dealt during play of the draw poker game, the matrix having a plurality of columns and plural pay lines pass through one card in each column of the matrix, the method comprising the steps of:

(a) dealing cards face up in less than all the positions of one row of positions through the matrix;

(b) letting the player select any of the cards dealt in step (a) to be held;

(c) replacing the card(s) that are not held in step (b);

(d) dealing face up cards in the positions of the one row of positions through the matrix that did not have a card dealt therein in step (a) to complete a hand of cards in that row;

(e) dealing a face up card into matrix positions above and/or below certain other positions of the row through the matrix, the number of other positions being less than the number of all the positions of the row through the matrix; and (d) determining which pay lines through the matrix having winning combinations of cards along them.

6. The method for playing a draw poker game in accordance with claim 5 wherein the one row through the matrix has five positions into which cards can be dealt.

7. The method for playing a draw poker game in accordance with claim 6 wherein the cards dealt face up in step (e) are above and below positions of the one row of positions through the matrix that did not have a card dealt therein in step (a).

* * * * *